US005462169A

United States Patent [19]

Dygert et al.

[11] Patent Number: 5,462,169

[45] Date of Patent: Oct. 31, 1995

[54] COMPOSITE PACKAGE FOR HAZARDOUS MATERIALS

[75] Inventors: Douglas M. Dygert, Olive Branch, Miss.; Clifford B. Radcliffe, Yorktown Heights, N.Y.

[73] Assignee: Ring Can Corporation, Oakland, Tenn.

[21] Appl. No.: 311,272

[22] Filed: Sep. 23, 1994

[51] Int. Cl.[6] ..... B65D 21/02; B67D 5/00

[52] U.S. Cl. ..... 206/521; 220/410; 220/408; 222/183; 229/242

[58] Field of Search ..... 206/521, 591; 220/408, 409, 410, 465; 229/242; 222/183, 465.1

[56] References Cited

U.S. PATENT DOCUMENTS

| | | | |
|---|---|---|---|
| 1,594,433 | 8/1926 | Towle . | |
| 2,954,901 | 10/1960 | Winstead . | |
| 3,054,549 | 9/1962 | Humphrey . | |
| 3,119,544 | 1/1964 | Cope et al. . | |
| 3,160,326 | 12/1964 | Sturdevant et al. . | |
| 3,170,601 | 2/1965 | Daley . | |
| 3,233,817 | 2/1966 | Casady . | |
| 3,240,417 | 3/1966 | Andreini . | |
| 3,246,825 | 4/1966 | Zastrow | 222/183 |
| 3,329,316 | 7/1967 | Lowe . | |
| 3,349,986 | 10/1967 | Chapman et al. . | |
| 3,499,582 | 3/1970 | Berney . | |
| 3,819,036 | 6/1974 | Weldon . | |
| 4,133,428 | 1/1979 | Glöyer . | |
| 4,524,883 | 6/1985 | Herring . | |
| 4,811,870 | 3/1989 | Blanco . | |
| 4,927,042 | 6/1990 | Ring . | |
| 5,074,429 | 12/1991 | Konkel et al. | 220/465 |
| 5,144,028 | 6/1992 | Ring . | |
| 5,213,215 | 6/1993 | Prevot . | |
| 5,295,610 | 3/1994 | Levison . | |

*Primary Examiner*—Paul T. Sewell
*Assistant Examiner*—Marie Denise Patterson
*Attorney, Agent, or Firm*—Nies, Kurz, Bergert & Tamburro

[57] ABSTRACT

A novel composite package including a rectangular, outer, paperboard box and a rectangular, thin-walled, lightweight, molded plastic bottle within the box suitable for use with hazardous liquid materials. At its upper end, the bottle has a pouring spout adjacent its front wall and an elongated hollow handle extending from the pouring spout to the rear wall and defining an air passageway between the pouring spout and the liquid containing chamber within the bottle. A vent spout is provided at the rear of the hollow handle. The top flap assembly of the box includes knock-out flap portions which overlie the pouring spout, the hollow handle, and the vent spout, those knock-out portions being removable when it is desirable to pour liquid from the package. A pair of paperboard reinforcing pads are placed between the underside of the top flap assembly and the top of the plastic bottle, the pads enhancing the crush resistance and impact strength of the package.

15 Claims, 3 Drawing Sheets

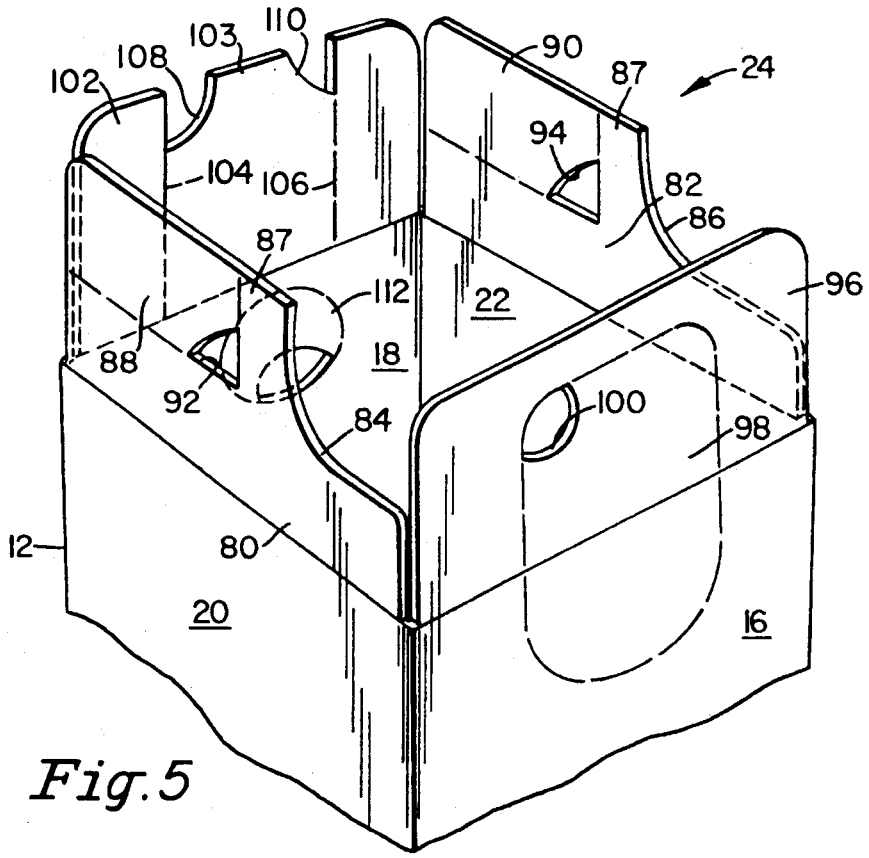
Fig. 5
Fig. 6
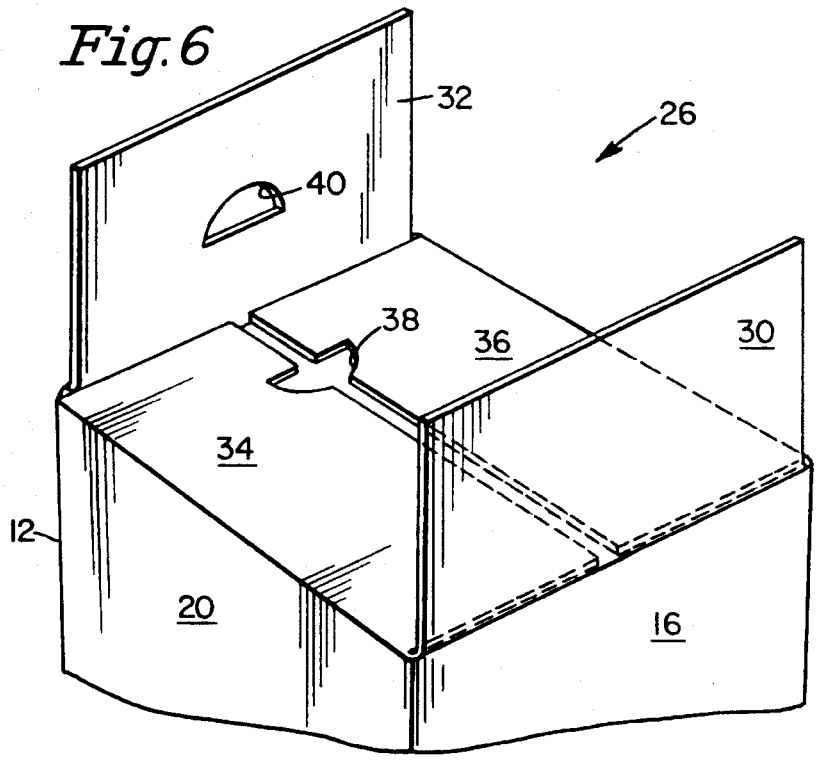

COMPOSITE PACKAGE FOR HAZARDOUS MATERIALS

BACKGROUND OF THE INVENTION

This invention relates generally to a composite package or container which includes a thin-walled, lightweight, molded, plastic bottle contained within an outer fiberboard or paperboard carton. More particularly, the invention relates to such a novel composite package which is especially adapted for the packaging and handling of medium danger hazardous liquid materials such as photo developing chemicals, cleaning solvents, lubricants, etc. A package used for this purpose must resist breakage and leakage to ensure the safety of personnel handling and/or transporting the package.

In particular, this invention is directed to a composite package which satisfies the requirements of the Department of Transportation (DOT)/United Nations (UN) Performance Certification Package Code Designation 6HG2 for Plastics Receptacle with Outer Fiberboard Box, Packing Group II Medium Danger Hazardous Materials. To attain that certification the package must pass a number of standardized tests, e.g., impact drop tests for filled packages, leak proofness air tests, hydrostatic leakage tests, stack tests with filled boxes for compression resistance, repetitive shock vibration tests, and water absorption tests for the paperboard box.

Because of their lightweight construction and economical cost, prior composite packages have been particularly useful for packaging non-hazardous liquid materials such as edible food oils, etc. and have been commonly used in sizes from 2 to 5 gallon containers. The assignee of this application is a primary supplier of such prior composite containers for use with non-hazardous materials. This invention now provides a composite package for use with hazardous materials.

SUMMARY OF THE INVENTION

Accordingly, a primary object of this invention resides in the provision of a composite package including an outer paperboard or fiberboard box and a thin-walled lightweight molded plastic bottle within the box suitable for use with hazardous liquid materials.

Still another object of this invention resides in the provision of the above novel composite package in which the plastic bottle includes a pouring spout mounted on a neck platform adjacent the front wall of the bottle, a hollow handle extending from the neck platform to the rear wall of the bottle, and a vent spout at the rear of the hollow handle to prevent glugging action as the liquid is poured from the pouring spout.

A further object of this invention is to provide the above described composite package wherein the outer paperboard canon includes perforated areas which may be knocked out to provide access to the pouring spout, the handle, and the vent cap when the liquid is to be poured from the package.

Another object of the invention is to provide the above novel composite package in which crush resistant support pads are provided between the top wall of the plastic bottle and the flaps closing the top of the paperboard box to provide strength to the package during shipping, storage, and handling.

A further object of this invention resides in the provision of the above, novel composite package which may be used to safely and conveniently transport and dispense hazardous liquid materials.

Other objects and advantages of the invention will become apparent from reading the following detailed description of the invention wherein reference is made to the accompanying drawings.

BRIEF DESCRIPTION OF THE DRAWINGS

FIG. 5 is a fragmentary front elevational view of the outer paperboard box illustrating the top flap assembly in its open, unfolded condition.

FIG. 6 is a fragmentary perspective view of the bottom flap assembly of the outer paperboard box.

DETAILED DESCRIPTION OF THE INVENTION

Figure 1:
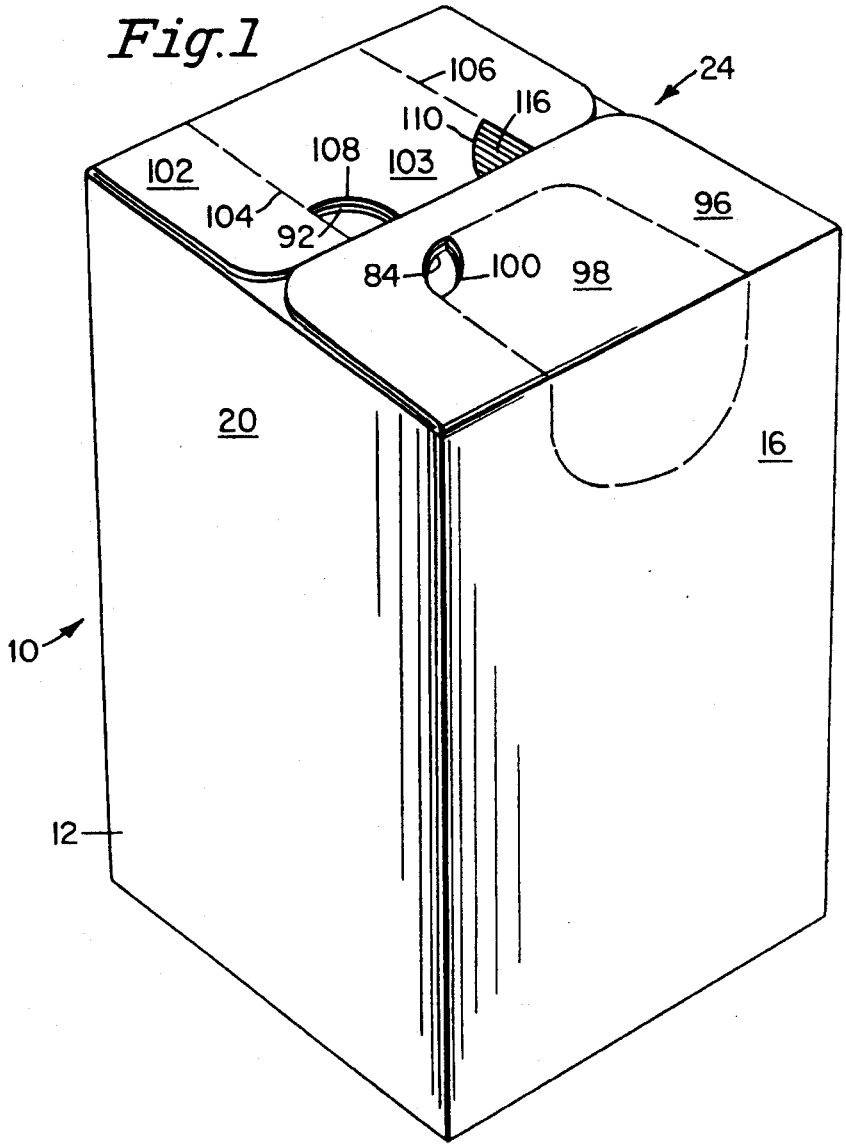
FIG. 1 is a front perspective view of the composite package of the invention.

Referring now to the drawings, the novel rectangular composite package or container 10 includes an outer rectangular, preferably square, corrugated paperboard box 12 and a thin-walled, semi-rigid, lightweight, square, molded plastic bottle 14 which fits snugly within box 12. Bottle 14 may be of a size sufficient to contain, for example, two to five gallons of liquid material.

Outer cardboard box 12 includes front wall 16, rear wall 18, side walls 20 and 22, a foldable top end flap assembly 24 (FIGS. 1, 2, & 5), and a foldable bottom end flap assembly 26 (FIG. 6). Bottom flap assembly 26 includes front flap 30, rear flap 32, and side flaps 34 and 36, each having a die-cut section which, when the flaps are folded, oppose each other to form hand opening 38. Rear flap 32 is provided with a die-cut opening 40. When flaps 30 and 32 are folded over and glued onto flaps 34 and 36, opening 40 overlies opening 38, which together form a hand-receiving opening on the bottom of box 12.

Figure 3:
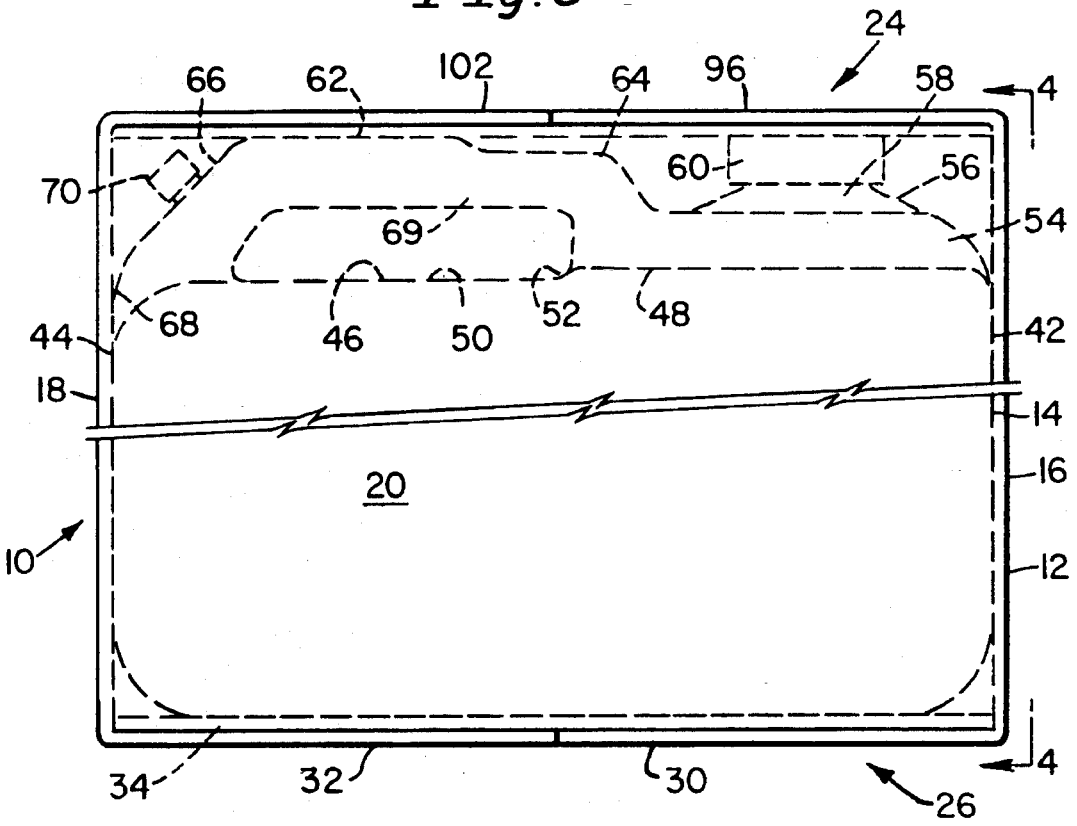
FIG. 3 is a fragmentary side elevation view of the composite package of FIG. 1 illustrating in broken line the plastic bottle housed within the outer paperboard box.
Figure 4:
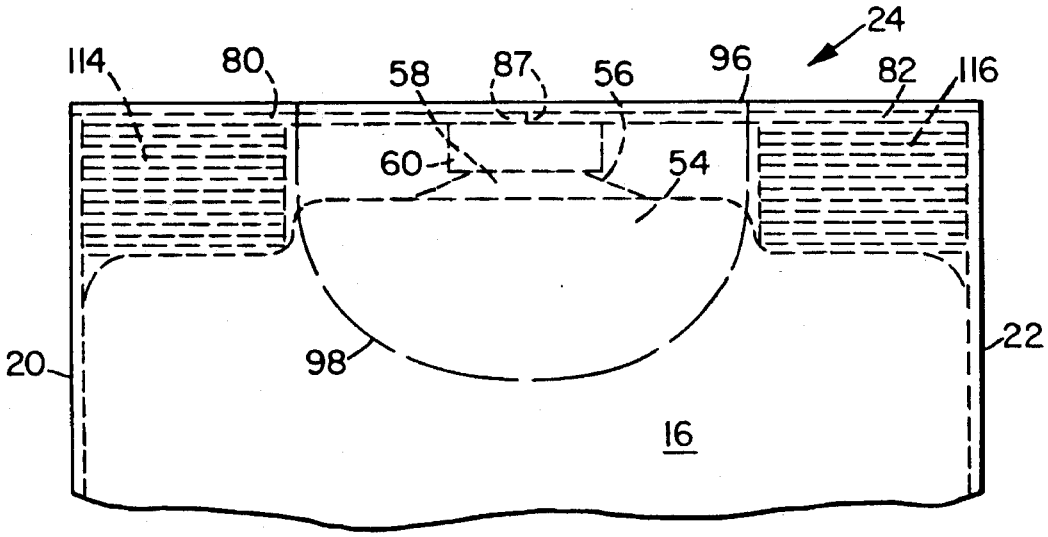
FIG. 4 is a fragmentary front elevational view taken generally along line 4—4 of FIG. 3.

As shown in FIGS. 3 & 4, square bottle 14 fits closely within box 12 and rests on the bottom flap assembly 26. Bottle 14 includes front wall 42, rear wall 44, and top wall 46 having a neck platform and bridge top configuration essentially the same as that illustrated in U.S. Pat. No. 5,114,028, owned by the assignee of this application. For example, top wall 46 has a raised forward section 48 and a slightly lower rearward section 50 blended together at about the midpoint 52 between walls 42 and 44.

Integrally formed on top of section 48 is a triangular neck platform 54 having a front or forward wall which extends along and coextensively upwardly from wall 42 and blends with a top wall portion 56 on which is formed a circular threaded filling and pouring spout 58, which is normally closed by a threaded cap 60.

A narrow U-shaped hollow handle 62 is connected at its forward end 64 to the rear section of neck platform 54 and extends generally horizontally rearwardly to a downwardly inclined section 66 which connects at its rearward end 68 to rear wall 44. The hollow handle 62 provides an air passageway 69 from neck platform 54 and spout 58 leading to the rearward end 68 which opens into and communicates with the liquid containing chamber within bottle 14. A small threaded air venting spout 70 normally closed by a threaded cap is formed on the downwardly inclined section 66 of handle 62. Inclined section 66 provides adequate clearance between spout 70 and rear wall 18 and flap 102 of box 12. During a pouring operation, the cap on spout 70 is removed to introduce air into passageway 69 and thereby help in preventing glugging of the liquid being poured through spout 58.

Top flap assembly 24 includes side flaps 80 and 82, the front edges of which have curved, die cut sections 84 and 86 extending from opposed center sections 87 toward front wall 16. The rear edges have generally rectangular, perforated, knock-out sections 88 and 90, formed with finger openings 92 and 94. Front flap 96 has a perforated knock-out section 98 which also extends downwardly into front wall 16 and a finger opening 100. Rear flap 102 has a central knock-out section 103 formed along perforated lines 104 and 106, with section 103 having spaced die-cut openings 108 and 110.

When the top flap assembly 24 is closed, the die cut out areas 84 and 86 of side flaps 80 and 82, provide plenty of clearance around spout 58. When rear flap 102 is folded over on top of side flaps 80 and 82, cut-outs 108 and 110 overlie and align with finger openings 92 and 94. When front flap 96 is folded over side flaps 80 and 82, the removable knock-out section 98 overlies the die-cut opening formed by sections 84 and 86 so that when knock-out 98 is removed along the perforated line, the cap 60 on spout 58 may be easily removed and rethreaded in place.

Figure 2:
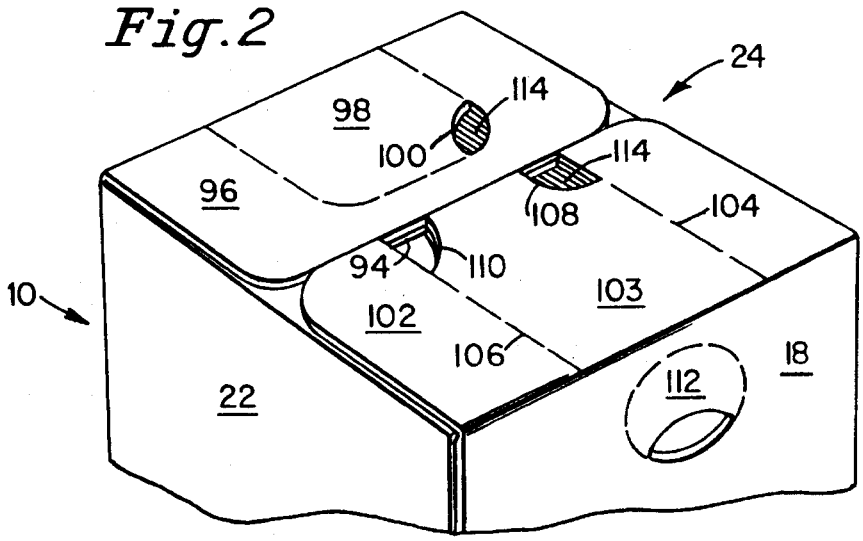
FIG. 2 is a fragmentary rear perspective view of the composite package of the invention.

A circular perforated knock-out section 112 is provided on rear wall 18 of box 12 to afford access to vent spout 70 when liquid is to be poured from bottle 14. As shown in FIG. 4, a pair of corrugated reinforcing support pads 114 and 116 are located between the underface of side flaps 80 and 82 and top wall 46. The pads are positioned on opposite sides of neck platform 54 and extend substantially the full distance between front wall 16 and rear wall 18 of box 12 (FIGS. 1 & 2).

As mentioned previously, the composite package 10 of the invention may be of various sizes, but it is particularly applicable to larger sizes, for example, 2 to 5 gallon packages. A five gallon package constructed according to the invention has satisfied the performance criteria for the DOT/UN packaging code designation 6HG2. In that composite package, the outer paperboard box 12 was formed from 275 pound test, double-wall Kraft corrugated fiberboard with a wall thickness of about 0.265 inches. When the box is set up and folded, and the top and bottom flap assemblies are sealed, the inside dimensions are approximately 9 9/16 inches long by 9 9/16 inches wide by 16 inches deep. The five gallon square blow molded bottle was formed from high-density polyethylene Chevron 9506 material having a wall thickness of 0.023 inches. The size of the bottle was approximately 9.38 inches wide by 9.38 inches long by 15.91 inches high, and the bottle 14 fits closely within the paperboard box 12. The top tabs 114 and 116 were of the same double-wall Kraft corrugated paperboard and were approximately 1 5/8 inches thick by 2 3/8 inches wide by 9 7/16 inches long.

The composite package 10 is assembled as follows. A preformed die-cut paperboard blank is folded into square shape, and the bottom flap assembly 26 is sealed by gluing as described above. An empty blown plastic bottle 14 with a cap on the vent spout 70 is placed into box 20 with the pouring spout 58 adjacent front wall 16 and flap 96. Reinforcing pads 114 and 116 are then placed on the top wall of bottle 14 in spaced relationship on opposite sides of neck platform 54 (FIG. 4), with the pads extending substantially the full length between front wall 16 and rear wall 18 of box 12. Side flaps 80 and 82 are then folded inwardly into contact with the top of pads 114 and 116 and rear flap 102 is then folded inwardly and glued on top of side flaps 80 and 82. In this assembled condition, the tear-out section 103 of flap 102 overlies the tear-out sections 88 and 90 of flaps 80 and 82 respectively, and the finger openings 108 and 110 overlie the openings 92 and 94. The forward cut-out areas 84 and 86 of side flaps 80 and 82 provide plenty of clearance around spout 58 so that the cap on the spout may be easily tightened and removed when desired.

The bottle 14 is then filled with a liquid and the spout 58 is then closed with an appropriate cap 60. Front flap 96 is then folded over and glued on top of side flaps 80 and 82. The knock-out section 98 will overlie the die-cut opening formed by sections 84 and 86. During shipping, the tear-away, knock-out sections 88, 90, 98, and 103 all remain in place, and provide strength to the paperboard box 12, thereby protecting the filled bottle 14 contained within box 12. During shipping, the packages 12 are usually stacked three high on a pallet, and the pads 114 and 116 and the construction of the flaps 80, 82, 96 and 102 increase the crush-resistance and compression strength of the package 10.

When the package is to be used, a person places a finger in opening 100 and tears away the knock-out section 98 to provide easy access to the cap on spout 58. Similarly, the person places his finger into aligned openings 108, 92, and 110, 94, and tears away the perforated sections 88, 90, and 103, thereby exposing handle 62 of bottle 14. The circular knock-out section 112 on rear wall 18 is also torn away to provide access to the vent spout 70.

To pour the liquid from the package 10, the cap on pouring spout 58 is removed and the cap on vent spout 70 is removed. The person then grips handle 62 with one hand and the hand opening formed by aligned openings 38 and 40 on the bottom of box 12 with the other hand to pour liquid from bottle 14 through pouring spout 58. As liquid is poured over the forward edge of spout 58, air enters passageway 69 of the hollow handle 62 from the rear edge of spout 58 and also through the vent spout 70 and passes into bottle 14 to eliminate any glugging action of the liquid as it is being poured. In handling hazardous liquids, it is especially desirable to provide a smooth liquid flow through the pouring spout and to avoid any glugging action which might cause the liquid to spill or splash on persons nearby. After a desired amount of liquid has been poured from bottle 14, package 10 is again placed in its upright position and the caps are replaced on pouring spout 58 and vent spout 70.

The invention may be embodied in other specific forms without departing from the spirit or essential characteristics thereof. The present embodiment is therefore to be considered in all respects as illustrative and not restrictive, the scope of the invention being indicated by the appended claims rather than by the foregoing description, and all changes which come within the meaning and range of equivalency of the claims are therefore intended to be embraced therein.

We claim:

1. A composite package comprising:

an outer rectangular paperboard box and a thin-walled, rectangular plastic bottle mounted within said box;

said bottle having a bottom wall, vertical front, rear, and first and second side walls extending upwardly from said bottom wall, a top wall extending across said vertical walls and defining a fluid containing chamber therewith, a pouring spout formed on said top wall adjacent said front wall, a handle formed on said top wall and extending between said pouring spout and said rear wall, said handle having an air passageway communicating with said chamber adjacent said rear wall, an air vent spout formed on said handle in communication with said passageway;

said paperboard box including front, rear, and first and second side walls adjacent the front, rear, and first and second side walls, respectively, of said bottle, said box having a top flap assembly including first and second side flaps connected to the side walls of said box and folded substantially perpendicular to said side walls, front and rear flaps connected to said front and rear walls of said box and folded over said side flaps, said front flap having a tear-away section overlying said spout and being removable when said fluid is to be poured from said spout, said rear flap having a tear-away section overlying said handle and being removable to provide access to said handle, a tear-away section on said rear wall of said box to provide access to said vent spout.

2. The composite package defined in claim 1, comprising reinforcing means located between said folded side flaps and said top wall of said bottle.

3. The composite package defined in claim 1, said first and second side flaps including tear-away sections at their rearward edges underlying the tear-away section of said rear flap and being removable together therewith to provide access to said handle.

4. The composite package defined in claim 3, said first and second side flaps having cut-out sections at their front edges to provide clearance around said spout when said tear-away section of said front flap is removed.

5. The composite package defined in claim 1, said tear-away section on said front flap extending a distance downwardly on said front wall of said box.

6. The composite package defined in claim 1, said handle being hollow to define said air passageway to connect said spout with said chamber.

7. The composite package defined in claim 1, said box having a bottom folded flap assembly adjacent the bottom of said bottle, said bottom flap assembly including a hand-receiving opening to assist in pouring fluid from said bottle.

8. The composite package defined in claim 1, said bottle having a raised platform formed on said top wall adjacent said front wall of said bottle and said spout being formed on said platform, said handle being hollow and extending between said platform and said rear wall and connecting said pouring spout with said chamber.

9. The composite packaged defined in claim 8, comprising a pair of elongated reinforcing pads located between said folded side flaps and said top wall of said bottle, said pads being spaced on opposite sides of said platform and said handle.

10. A composite package comprising an outer rectangular paperboard box and a thin-walled rectangular plastic bottle mounted within said box;

said bottle having a bottom wall, vertical front, rear, and first and second side walls extending upwardly from said bottom wall, a top wall extending across said vertical walls and defining a fluid-containing chamber therewith, a pouring spout formed on said top wall adjacent said front wall, a hollow handle formed on said top wall and extending between said pouring spout and said rear wall, said hollow handle defining an air passageway connecting said spout with said chamber, an air vent spout formed on said handle in communication with said passageway;

said paperboard box including front, rear, and first and second side walls adjacent the front, rear, and first and second side walls, respectively, of said bottle, said box having a top flap assembly including first and second side flaps connected to the side walls of said box folded substantially perpendicular to said side walls, said first and second side flaps having tear-away sections at their rearward edges overlying said handle and cut out sections at their front edges to provide clearance around said spout, said top flap assembly also including front and rear flaps connected to said front and rear walls of said box and folded over said side flaps, said front flap having a tear-away section overlying said spout and being removable when fluid is to be poured from said spout, said rear flap having a tear-away section overlying the tear-away sections of said first and second side flaps and being removable therewith to provide access to said handle, a tear-away section on said rear wall of said box to provide access to said vent spout, and reinforcing means located between said folded side flaps of said box and said top wall of said bottle.

11. The composite package defined in claim 10, said bottle having a raised platform formed on said top wall adjacent said front wall of said bottle and said spout being formed on said platform, said hollow handle extending between said platform and said rear wall and connecting said pouring spout to said chamber, said reinforcing means comprising a pair of elongated reinforcing pads spaced on opposite sides of said platform and said handle.

12. The composite package defined in claim 11, said reinforcing pads extending substantially the full distance between said front and rear walls of said box.

13. The composite package defined in claim 12, said reinforcing pads being of paperboard.

14. The composite package defined in claim 11, said box having a bottom folded flap assembly which includes a hand-receiving opening to assist in pouring said fluid from said bottle.

15. The composite package defined in claim 11, said tear-away section on said front flap extending a distance downwardly on said front wall of said box.

* * * * *